United States Patent [19]

Weiss et al.

[11] 4,110,876

[45] Sep. 5, 1978

[54] JET MUFFLER

[75] Inventors: William Robert Weiss, Walnut Creek, Calif.; James Judson Cooksey, Colonial Heights; Rob Roy Gordon, Jr., Suffolk, both of Va.

[73] Assignee: Allied Chemical Corporation, Morris Township, Morris County, N.J.

[21] Appl. No.: 828,053

[22] Filed: Aug. 26, 1977

[51] Int. Cl.[2] ..... D02G 1/16

[52] U.S. Cl. ..... 28/271; 55/276; 181/200; 226/97; 425/211

[58] Field of Search ..... 28/271; 181/198, 200, 181/247, 256; 226/7, 97; 425/72, 211; 55/276

[56] References Cited

U.S. PATENT DOCUMENTS

| | | | |
|---|---|---|---|
| 3,713,509 | 1/1973 | Carroll | 181/200 |
| 4,024,698 | 5/1977 | Weiss et al. | 28/271 X |
| 4,030,651 | 6/1977 | Weiss et al. | 226/97 |
| 4,040,782 | 8/1977 | Weiss et al. | 28/271 |
| 4,043,008 | 8/1977 | Weiss et al. | 28/271 |

*Primary Examiner*—Louis K. Rimrodt
*Attorney, Agent, or Firm*—Richard A. Anderson

[57] ABSTRACT

A muffler is provided for use in conjunction with a jet for treating a running length of yarn. Audible noise which is emitted by the jet is reduced by at least 11.5 ΔdB(A) through the use of a housing to substantially enclose the jet. The housing has openings for the entrance and exit of a yarn and is at least partially lined with sound absorbing material; sound absorbing material also closes the openings in the housing. The travelling yarn abrades through the sound absorbing material at the openings to form an operational passage to and from the jet.

11 Claims, 2 Drawing Figures

JET MUFFLER

BACKGROUND OF THE INVENTION

This invention relates to an apparatus for use during the production of multifilament, synthetic yarn. In particular, it relates to a muffler for use in conjunction with a yarn treating jet for the continuous fluid treatment of running ends of yarn. The jet has at least one yarn passage therethrough and fluid conduits in communication with each of the yarn passages for delivery of the treating fluid.

Throughout the present specification and claims, the term "dB(A)" (decibels — A-weighted) connotes a unit of measurement of sound level corrected to the A-weighted scale, as defined in ANSI SI.4-1971, using a reference level of 20 micropascals ($2\times10^{-5}$ Newtons per square meter). The term "ΔdB(A)" refers to the difference between two noise levels where each level is expressed in units of dB(A). The term "yarn" is employed in a general sense to indicate strand material, either textile or otherwise, and including a continuous, often plied, strand composed of fibers, filaments, glass, metal, asbestos, paper, or plastic, or a noncontinuous strand such as staple, and the like. An "end" is one or a contiguous group of such strands of yarn. The treating fluid to be used may be virtually any gas, as for example air, steam, nitrogen, oxygen, or carbon dioxide.

The invention is applicable to many phases of yarn handling, the particular use disclosed herein being merely illustrative and not limiting thereof.

Jets have become widely used in recent years for the treatment of industrial and textile yarns. Different jets are used for the various end uses with specific designs having been developed according to the yarn treatment to be effected. Fluid jets have been utilized for such diverse yarn treating operations as entangling, conveying, twisting, crimping, fluffing, localizing the draw point, or otherwise agitating or treating the yarn by means of treating fluid.

All of these jets utilize a fluid which may issue therefrom at high speeds and pressures creating an extremely high noise level. The problem may be further compounded when the treatment comprises a series of fluid treating jets and/or when a plurality of treatment positions are operated simultaneously. The type of muffling device to be employed obviously depends on where the noise issues from the jet. In a fluid treating jet which has a yarn passage therethrough and fluid conduits in communication therewith, the high velocity of the treating fluid jetting out of the fluid conduit into the yarn passage shears into the ambient air thereby creating noise producing turbulent eddies. The cant and direction of the fluid conduits with respect to the yarn passage determines the primary area or areas of noise issuance from the jet. For instance, a treating jet having a fluid conduit at a relatively small angular cant from the yarn passage and directed toward the exhaust end of the yarn passage will have noise issuing primarily from its exit end; this is due to the aspirating effect of the yarn passage with respect to the high velocity air which acts as an impedance to sound waves issuing from the entrance end. However, a treating jet having a fluid conduit approaching more nearly a 90° cant from the yarn passage will have noise issuing more equally from its entrance and exit ends; the jet of treating fluid interacts with the yarn passage to propagate noise in both directions, there being no impedance to sound waves issuing from the entrance end. An increasing angular cant of the fluid conduit from the yarn passage will result in a decreasing aspirating effect and accordingly, in progressively more noise issuing from both ends. Also, if the yarn passage has an adjacent access slot, noise will issue therefrom.

There are various muffling devices known in the art for reduction of noise issuing from a yarn treating jet. There are basically three types of muffling devices or combinations thereof: access slot silencers; entrance or exhaust mufflers; and jet enclosures.

There are several devices in the art for sealing of the access slot. U.S. Pat. No. 3,296,679 relies upon the slideability of a closure plate and gravity to seal the access slot of a fluid treating jet. U.S. Pat. No. 3,905,075 discloses a noise reduction and heat direction system wherein actuating means trips the pivot of noise damping means to cause a wedge to seal the access slot. Both of U.S. Pat. Nos. 3,363,294 and 3,394,440 rely upon fluid actuated movement of either the housing or closure means within the housing for the alignment or misalignment of yarn receiving slots during string-up and operation, to thereby accomplish the automatic sealing of an access slot by fluid operation of the jet. Although access slot silencers of the aforementioned types are effective, the blocking of the access slot alone simply means that the directivity pattern of noise radiation has been changed, i.e., the noise will radiate in a different direction, for instance through the jet entrance and/or exhaust.

There are also several devices in the art which muffle noise issuing primarily from the entrance or exit ends of a yarn treating jet. U.S. Pat. No. 4,043,008 discloses an exhaust muffler which has a hinged door operating in conjunction with an access slot silencer to lower the overall noise level of a yarn treating jet during operation. U.S. Pat. No. 3,127,729 discloses a jet muffler shroud which substantially encloses the exit from a yarn treating jet. Another exhaust muffler is taught by U.S. Pat. No. 4,030,651, for use in conjunction with an interfloor tube aspirator. Another aspirator muffler is disclosed by U.S. Pat. No. 4,024,698, but this is primarily an inlet muffler. Although entrance or exhaust mufflers of the aforementioned types are effective, it is highly desirable to have a muffler which will effectively attenuate noise regardless of the primary source, when dealing with yarn treating jets. Assuming that redesigning the yarn treating jet is not feasible, the best approach is enclosure.

The jet enclosure concept is also known. U.S. Pat. No. 3,713,509 teaches a textile interlacing apparatus which is surrounded with a sound proofing chamber coupled with muffled exhaust ports. U.S. Pat. No. 3,167,847 discloses an improved yarn intertwining jet which includes a blanket of sound insulating or absorbing material overlying the entire exposed surface of its housing and surrounding the operating zone; the coverplate to the housing also has sound absorbing material thereon. U.S. Pat. No. 3,305,910 teaches yarn diverting apparatus which is located in an acoustical enclosure.

The actual sound absorbing materials disclosed by these patents are high porosity low density structures (U.S. Pat. No. 3,713,509); ridid sound absorbing material such as glass fibers (U.S. Pat. No. 3,127,729); foam rubber felt, or porous plastics (U.S. Pat. No. 3,167,847); and completely metal sound absorbing inserts (U.S. Pat. No. 4,043,008).

The primary problem in designing a jet enclosure type of muffler is the inherent conflict between acoustical objectives and process objectives. Acoustically, it is desirable to enclose as much of the jet as possible; however, from a process point of view it is desirable to have no impedance to the yarn path at all. It is impossible to completely enclose a yarn treating jet as the running length of yarn must have some means provided for access to the jet. Provision of large openings or slots (see U.S. Pat. No. 3,305,910) in the enclosure for yarn passage is acoustically undesirable as noise will escape therefrom. However, restricting the openings to a very small size in an enclosure formed of a nonpliable material (see U.S. Pat. No. 3,713,509) may cause regeneration of noise; the high velocity of air issuing from the jet will shear across the edge of the small opening to create more noise. Another problem associated with such small openings is the increased risk of yarn to metal contact, which is undesirable from a process point of view (see U.S. Pat. No. 3,167,847).

Applicants have surprisingly developed a jet enclosure type of muffler which solves the aforementioned problems. Additionally, the design of the present invention is such that the functional life of the sound absorbing material is increased.

SUMMARY OF THE INVENTION

The present invention provides a muffler for use in conjunction with a jet for treating a running length of yarn. The essential elements are a rigid housing, sound absorbing material, and means for mounting the sound absorbing material to the interior of the housing.

The rigid housing, which substantially encloses the jet, has openings therein for the entrance and exit of a yarn, the openings being larger than the cross-section of the yarn.

The sound absorbing material lines at least 60 to 70 percent of the interior of the housing and in addition thereto closes the openings in the housing. The portion of the sound absorbing material which closes the openings has a slit therethrough to permit passage of the yarn into and out of the housing for passage through the jet. The portion of the sound absorbing material which closes the openings partially abrades when coming into contact with the yarn when the jet is operational.

Means is provided for mounting the sound absorbing material to the interior of the housing.

The noise level of the jet when operational is reduced by the muffler. The invention will be more clearly understood and additional objects and advantages will become apparent upon reference to the discussion below and to the drawings which are given for illustrative purposes.

DETAILED DESCRIPTION OF THE DRAWINGS

Figure 1:
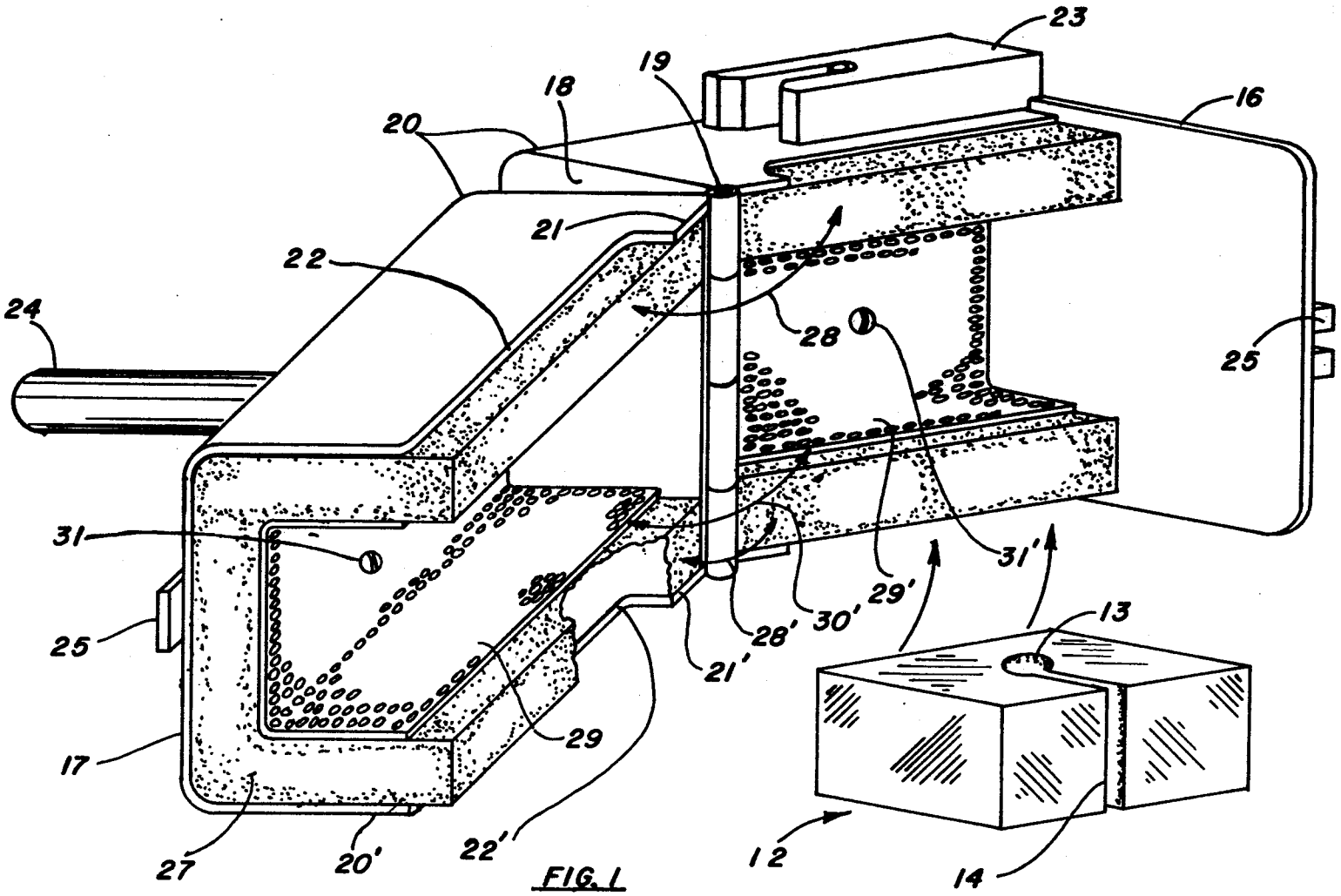
FIG. 1 is an oblique view of muffler 15 in the open position, with arrows indicating the position of jet 12.

With reference to the accompanying drawings, like numbers indicate like apparatus. In the preferred embodiment of the invention, a single yarn end 11 is strung-up and treated in a yarn treating jet 12.

Jet 12 has a yarn passage 13 therethrough with an adjacent access slot 14 to facilitate string-up. There are fluid conduits (not shown) which open on yarn passage 13 to admit treating fluid supplied by a fluid manifold (not shown). When jet 12 is operational, noise issues from the entrance and exit ends of yarn passage 13 and from access slot 14.

The muffler 15 of the present invention has as its major elements a mounting plate 16, a boxlike metal housing 17, sound absorbing material 27, and perforated metal sheet retainers 29 and 29'.

Mounting plate 16 functions as a first face of housing 17 to form in conjunction therewith an enclosure for jet 12. Housing 17 has a second face 18 which is opposite to mounting plate 16 and which has hinge means 19 thereacross. Two of the other faces 20 and 20' of housing 17, which are parallel to each other and intersect the axis of hinge means 19 at about each of the ends of hinge means 19, each have a slit 21 and 21', respectively, which runs from the end of hinge means 19 to mounting plate 16. Faces 20 and 20' are each cut away at their respective slits 21 and 21' to form openings 22 and 22', respectively, which are large enough for the passage of yarn end 11 therethrough and are in register with one another. Housing 17, and accordingly muffler 15, can be opened and closed by movement of housing 17 about hinge means 19. Housing 17, and accordingly muffler 15, attains an open position (see FIG. 1) by movement of housing 17 away from mounting plate 16 about hinge means 19. When muffler 15 is in the open position, an operator has access to jet 12 for its string-up and alignment. Housing 17 and accordingly muffler 15, is closed (see FIG. 2) by movement of housing 17 towards mounting plate 16 about hinge means 19. When muffler 15 is in the closed position, and jet 12 is operational, muffler 15 reduces the noise level of jet 12.

Means 23 is provided for removably attaching housing 17 to mounting plate 16 and is depicted in the drawings by a slotted guide and guide pin. The guide pin is welded to housing 17 and slides to fit in the slotted guide which is welded to mounting plate 16. The guide pin positions housing 17 relative to mounting plate 16 and a screw secures the fit. To remove housing 17 from mounting plate 16, an operator simply loosens the screw and slides the guide pin attached to housing 17 out of the slotted guide. Thus, housing 17 can be readily attached or removed from mounting plate 16, the advantages of which will be discussed later. It should be noted that other conventional means of attachment may be employed, this detail being illustrative in nature.

Handle means 24 is also provided for opening and closing housing 17, and accordingly muffler 15. Handle means 24 is attached to housing 17, and by way of example may comprise a rod. If such a rod is used, it may optionally have a rubber sheath to improve gripping of the rod and to provide thermal insulation from the temperature of muffler 15, which may be hot.

First latching means 25 holds housing 17 in the closed position, and may comprise, for example, a magnet which is attached to mounting plate 16 and a magnetic surface attached to housing 17, the magnet and magnetic surface attracting and eventually holding one another when housing 17 is moved about hinge means 19 towards mounting plate 16. Second latching means 26 holds housing 17 in the open position, and may comprise, for example, a magnet which is attached to housing 17 on one side of hinge means 19 and a magnetic surface attached to housing 17 on the other side of hinge means 19, the magnet and magnetic surface attracting and eventually holding one another when housing 17 is moved about hinge means 19 away from mounting plate 16. Of course, in either of these examples, the magnet and magnetic surface may be interchanged. It should also be noted that other conventional latching means may be employed, this detail being illustrative in nature.

Sound absorbing material 27 lines the interior of housing 17 interior to the faces of 20 and 20' and the other surfaces adjacent and normal to mounting plate 16 and second face 18. Sound absorbing material 27 has two slits 28 and 28' therethrough, each of which corresponds to one of openings 22 and 22' in one of faces 20 and 20' of housing 17. Yarn passage 13 in jet 12 is in register with slits 28 and 28', when in use. Sound absorbing material 27 mates at slits 28 and 28', respectively, to substantially close openings 22 and 22' when housing 17 is in the closed position. Faces 20 and 20' open at their respective slits 21 and 21' in housing 17 to permit opening of housing 17. Likewise, sound absorbing material 27 parts at slits 28 and 28' when housing 17 is opened. Yarn end 11 passes to and from jet 12 through slits 28 and 28' in sound absorbing material 27. The portion of sound absorbing material 27 which closes openings 22 and 22' of housing 17 partially abrades when coming into contact with yarn end 11 when jet 12 is operational.

Two U-shaped perforated metal sheet retainers 29 and 29' function to retain sound absorbing material 27 against the faces of housing 17 which the sound absorbing material 27 is lining. Perforated metal sheet retainers 29 and 29' have an open area of from 35 to 95 percent, more preferably from 40 to 60 percent, and terminate at point approximately corresponding to openings 22 and 22'; when housing 17 is in the closed position, perforated metal sheet retainers 29 and 29' have gaps 30 and 30' therebetween which are of a width substantially similar to openings 22 and 22'. Means 31 and 31', respectively, are provided for detachably securing perforated metal sheet retainers 29 and 29' to housing 17 so that sound absorbing material 27 is retained thereby, and may be, for example, screws.

At the commencement of string-up, housing 17, and accordingly muffler 15, are in the open position (see FIG. 1) to provide access to jet 12. The operator brings yarn end 11 through yarn passage 13 via adjacent access slot 14 with string-up means (not shown). The operator now closes muffler 15 by pulling housing 17 into the closed position by handle means 24. First latching means 25 holds mounting plate 16 and housing 17 in the closed position. At this point, yarn end 11 passes inside of muffler 15 through slit 28 in sound absorbing material 27 and thence into jet 12. Yarn end 11 passes through jet 12 via yarn passage 13 and exits therefrom to pass out of muffler 15 through slit 28' in sound absorbing material 27. Treating fluid is now supplied to jet 12 and passes through the fluid conduits (unshown) into yarn passage 13 for treatment of yarn end 11. The treating fluid is preferably air. Yarn end 11 creates its own entrance and exit passages through muffler 15 to and from jet 12 by abrading a small portion of sound absorbing material 27 at slits 28 and 28'. When treatment is complete, the operator shuts off the treating fluid and opens muffler 15 by pullling housing 17 into the open position by handle means 24. Second latching means 26 holds housing 17 in the open position. It should be noted that the treating fluid can be supplied before closing of muffler 15 or shut off after opening of muffler 15; although this will transform jet 12 from a continuous noise source to an intermittent noise source, utilization of the preferred sequence will achieve further noise reduction.

The noise attendant operation of jet 12 is emitted from yarn passage 13 at its entrance and exit ends and the adjacent access slot 14. Housing 17 acts in conjunction with mounting plate 16 as a sound transmission loss barrier to block sound from leaving the enclosure. Sound absorbing material 27 functions as an absorbtive medium, transforming acoustical mechanical energy into heat energy. In this particular embodiment, it is not necessary to line mounting plate 16 and second face 18 of housing 17 with sound absorbing material 27 since lining of the same contributes only marginally to the reduction of noise emitted by jet 12. The most critical area of muffler 15 with respect to noise attenuation is openings 22 and 22' in housing 17. Without sound absorbing material 27, noise comes out of these openings 22 and 22' regardless of the relative positioning of muffler 15 and jet 12. Acoustically, no openings at all in muffler 15 would be ideal, but this is not practically feasible. It would seem that the solution to this problem would be to restrict the size of the openings to as small as possible while still permitting the free passage of yarn. However, when jet 12 and muffler 15 are aligned as depicted in the drawings, i.e., the exit and entrance ends of jet 12 are in line with openings 22 and 22' of muffler 15, restriction of openings 22 and 22' to a very small cross-sectional area will actually cause the generation of more noise; this is due to the shearing of the high velocity air emitted from the exit and entrance ends of the jet against the edges of these smaller openings to create more turbulence, and as a consequence, more noise. Very small openings are also undesirable from a process point of view as this increases the risk of yarn to metal contact when the jet is operational. The design of muffler 15 resolves these problems. Openings 22 and 22' are large enough to prevent either regeneration of noise or yarn to metal contact. Acoustically, openings 22 and 22' are effectively reduced in size by closing them with sound absorbing material 27 having slits 28 and 28', respectively, therethrough. Sound absorbing material 27 is more pliable than metal and thus does not generate increased turbulence and associated noise; it also functions to reduce noise at these critical areas by transforming acoustical mechanical energy to heat energy, the latter having no adverse effect on the process. When jet 12 has been strung-up, muffler 15 closed, and treating fluid supplied to jet 12, yarn end 11 will abrade sound absorbing material 27 to form a path into and out of muffler 15. It should be noted that yarn end 11 abrades only the minimum necessary path. Thus, muffler 15 achieves through minimum compromise the maximum noise reduction possible without adversely affecting the process.

Figure 2:
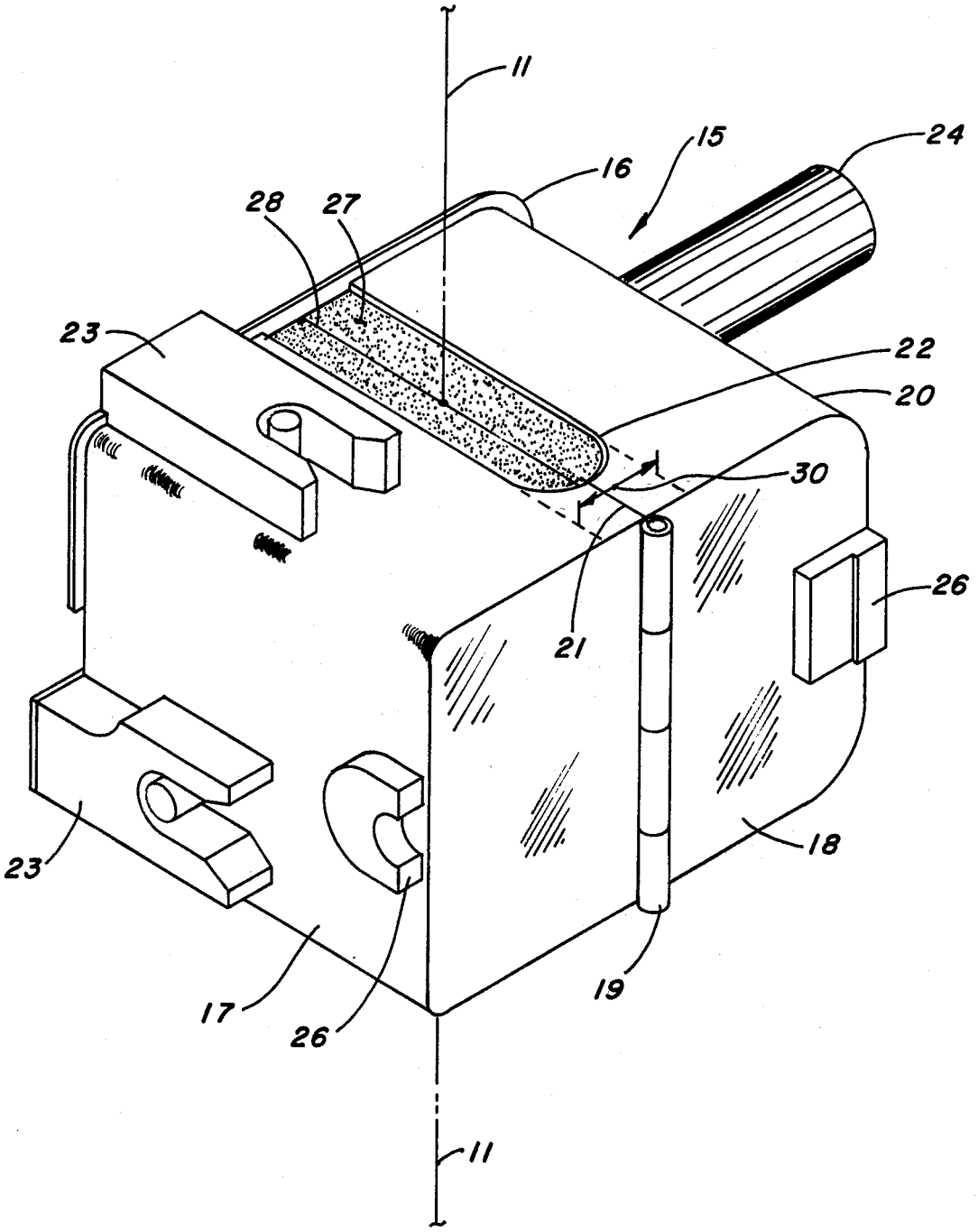
FIG. 2 is an isometric view of muffler 15 in the closed position.

By referring to FIG. 2, it will be seen that openings 22 and 22' in the preferred embodiment are substantially longer and wider than necessary to achieve the aforementioned desirable results. The slot-like shape serves four functions in addition to those previously mentioned. First, the slot-like shape aids in maintenance of the muffler, which will be discussed later. Second, muffler 15 is rendered more flexible thereby should greater pressures be utilized in treatment of yarn passing through jet 12. Assuming jet 12 has been operating with treating fluid supplied at a specific pressure, then yarn end 11 will have created a passage through sound absorbing material 27 of muffler 15. If it is desirable to adjust the pressure upward for treatment during a subsequent run (or for some other reason), then the yarn end passing through this previously created passage in muffler 15 may blow more laterally and abrade a larger passage for itself, again achieving the maximum noise reduction possible without adversely affecting the process. Third, although less desirable acoustically, this shape adds flexibility to muffler 15; should the positions of jet 12 and muffler 15 shift slightly with respect to one another so as to slightly vary the path of yarn end 11 through sound absorbing material 27, yarn end 11 will simply abrade some more of sound absorbing material 27 for passage therethrough, without contacting the metal of housing 17. This build in tolerance safeguards the process while still achieving noise reduction, albeit not as high as acoustically desirable. When the misalignment of jet 12 and muffler 15 is noticed by the operator, this can be changed. The fourth advantage of designing openings 22 and 22' in this manner is to permit the processing of multiple ends of yarn. So long as the multiple yarn ends feed in parallel to jet 12, then they can pass in parallel through sound absorbing material 27 at slits 28 and 28' and abrade their respective passages therethrough.

It is possible to utilize more than one type of sound absorbing material in muffler 15 without departing from the scope of the present invention, the only requirement being that the portion which closes openings 22 and 22' be more pliable than metal and capable of abrading when coming into contact with yarn end 11 when jet 12 is operational. However, for ease in fabrication and maintenance, it is preferred that sound absorbing material 27 be of a continuous length except for slits 28 and 28', and accordingly of one type of material, most preferably an opencelled foam. It is also preferred that sound absorbing material 27 line at least 60 to 70 percent of the interior of housing 17 and in addition thereto to close openings 22 and 22' in housing 17. Lining of the interior of housing 17 to a greater extend results in a negligible increase in noise reduction and lining to a lesser extent results in a significant decrease in noise reduction.

Perforated metal sheet retainers 29 and 29' serve a retentive function, as mentioned previously. Although sound absorbing material 27 can be affixed to the interior of housing 17 in other fashions, for example by gluing or bonding, use of perforated metal sheet retainers 29 and 29' maximizes the noise reduction capability of sound absorbing material 27. The durability of the preferred sound absorbing material 27, i.e., an opencelled foam, is limited. The combination of heat and oil absorption during operation causes sound absorbing materials 27 to degenerate and literally fall apart. Use of perforated metal sheet retainers 29 and 29' provides retention for sound absorbing material 27 even when it is saturated with oil and has broken apart. It should be noted that sound absorbing material which has deteriorated in such a fashion is still capable of absorbing sound waves so long as it is held in place. Thus, use of perforated metal sheet retainers 29 and 29' extends the useful life of sound absorbing material 27 and minimizes the frequency of its replacement. This cannot be done by simple adhesives or glues. The perforated metal sheet retainers 29 and 29' have an open area of from 35 to 95 percent, more preferably from 40 to 60 percent. An open area of under 35 percent decreases the absorbtion of sound waves by sound absorbing material 27, and an open area of greater than 95 percent decreases the retentive function of the perforated metal sheet retainers 29 and 29' to a critical degree. The purpose of terminating the perforated metal sheet retainers 29 and 29' at a point approximately corresponding to openings 22 and 22' is to decrease the risk of yarn to metal friction at openings 22 and 22'. Another advantage of using perforated metal sheet retainers 29 and 29' is maintenance ease. In order to replace sound absorbing material 27, an operator opens muffler 15 and releases means 23 which attaches housing 17 to mounting plate 16; he then removes means 31 and 31' for detachably securing the perforated metal sheet retainers 29 and 29' to housing 17, replaces sound absorbing material 27, and resecures the assembly. This may be done when jet 12 is operational or shut off. If jet 12 is not operational, it is not necessary to open muffler 15 before releasing means 23.

In another, less preferred embodiment, slits 28 and 28' in sound absorbing material 27 can be slightly wider than the cross-section of yarn end 11. In such an embodiment, housing 17 can be removed during operation of jet 12 for replacement of sound absorbing material 27. Removal is effectuated by release of means 23 for attaching housing 17 to mounting plate 16, for example by loosening a screw and sliding a guide pin attached to housing 17 out of a slotted guide attached to mounting plate 16. Expanded slits 28 and 28' allow clearance for running yarn end 11 during this operation. After replacing sound absorbing material 27, the housing 17 is reattached to mounting plate 16, the treatment process not being interrupted. During such period of time, jet 12 becomes an intermittent source of high level noise.

It is considered within the scope of this invention to provide a non-hinged housing which forms in conjunction with a mounting plate an enclosure for jet 12, and to provide an enclosure formed without a mounting plate which may be hinged or not, and either of which can be opened in some other manner.

The materials of construction are preferably as follows: for the sound absorbing material, fiber glass batt, a close-celled foam, or an open-celled foam, for example, fine pore polyester urethane foam, more preferably the latter; for the perforated metal sheet retainers, a metal such as stainless steel; for the screws, carbon steel or stainless steel; and for the other elements, a metal such as stainless steel or aluminum, more preferably the former for reasons of durability and noise attenuation.

EXAMPLE 1

The muffler of the present invention and a jet were installed in a position representative of their operative position relative to a draw panel in a spin draw process. The perforated metal sheet retainers 29 and 29' had an open area of approximately 50 percent. A non-reticulated fine pore polyster urethane foam was utilized as the sound absorbing material 27, more specifically Pyrell® foam, manufactured by the Scott Paper Company, Foam Division. The treating fluid was supplied at a line pressure of 65 psig., and the noise level was measured 2.5 feet from a point corresponding to the panel face of a draw panel and 5 feet above the ground plane. The readings obtained both with and without muffler 15 for the sake of comparison were, respectively, 87.5 dB(A) and 99 dB(A). The noise level was also measured 0.5 feet from a point corresponding to the panel face of a draw panel and 5 feet above the ground plane; the readings obtained both with and without muffler 15 for the sake of comparison were, respectively, 92 dB(A) and 103.5 dB(A). Thus the noise level of jet 12 is reduced by at least 11.5 ΔdB(A) by use of muffler 15. The aforementioned noise level readings were taken without closure of the panel doors. Closure of the panel doors should further reduce the noise level to below the present eight hour maximum continuous noise exposure level of 90 dB(A).

Example 1 above illustrates the preferred apparatus of the present invention and is not to be considered limiting of the invention in any means. Various modifications and other advantages will be apparent to one skilled in the art, and it is intended that this invention be limited only as set forth in the following claims.

It is claimed:

1. In combination with a yarn treating jet for use in the production of a running length of multifilament, synthetic yarn, a muffler comprising:

A. a mounting plate;

B. a boxlike metal housing, said mounting plate fucntioning as a first face of said housing to form in conjunction therewith an enclosure for said jet, said housing having a second face which is opposite to said mounting plate and which has hinge means thereacross, and two of the other faces of said housing which are parallel to each other and intersect the axis of said hinge means at about each of the ends of said hinge means each having a slit therethrough which runs from the end of said hinge means to said mounting plate, each of said two other faces being cut away at said slit to form an opening which is large enough for the passage of yarn therethrough and in register with one another, so that said housing can be opened and closed;

C. means for removably attaching said housing to said mounting plate;

D. handle means, said handle means being attached to said housing;

E. first latching means, said first latching means holding said housing in a closed position;

F. second latching means, said second latching means holding said housing in an open position;

G. sound absorbing material, said sound absorbing material lining the interior of said housing along the faces adjacent and normal to said mounting plate and said second face, said sound absorbing material having two slits therethrough each of which corresponds to one or said openings in one of said two other faces of said housing, said sound absorbing material mating at said slits to substantially close said openings when said housing is in said closed position, said yarn passing to and from said jet through said slits, the portion of said sound absorbing material closing said openings partially abrading when coming into contact with said yarn when said jet is operational;

H. two U-shaped perforated metal sheet retainers, each of said perforated metal sheet retainers having an open area of from 35 to 95 percent and functioning to retain said sound absorbing material against said faces of said housing which said sound absorbing material is lining, said perforated metal sheet retainers terminating at a point approximately corresponding to said openings in said two other faces of said housing so that when said housing is in said closed position said perforated metal sheet retainers have gaps therebetween which are of a width substantially similar to said openings; and I. means for detachably securing said perforated metal sheet retainers to said housing so that said sound absorbing material is retained thereby;

whereby the noise level of said jet is reduced by:

(1) the enclosure of said jet by said muffler when said mounting plate and said housing are moved into said closed position, said enclosure resulting from moving said housing on said hinge means via said handle means and triggering said latching means, and (2) permitting said yarn to create its own entrance and exit passages through said muffler to said jet, said entrance and exit passages being formed by said yarn abrading a small portion of said sound absorbing material at said slit when said jet is operational, and whereby the noise level of said jet is reduced by at least 11.5ΔdB(A) when said housing is in said closed position.

2. The apparatus of claim 1 wherein said sound absorbing material is a nonreticulated fine pore polyester urethane foam.

3. A muffler for use in conjunction with a jet for treating a running length of yarn, said muffler comprising:

A. a rigid housing to substantially enclose said jet having openings therein for the entrace and exit of a yarn, said openings being larger than the crossection of said yarn;

B. sound absorbing material, said sound absorbing material lining at least 60 to 70 percent of the interior of said housing and in addition thereto closing said openings in said housing, the portion of said sound absorbing material closing said openings having a slit therethrough to permit passage of said yarn into and out of said housing for passage through said jet, the portion of said sound absorbing material closing said openings partially abrading when coming into contact with said yarn when said jet is operational; and C. means for mounting said sound absorbing material to the interior of said housing;

whereby the noise level of said jet when operational is reduced by said muffler.

4. Apparatus as defined in claim 3 wherein said portion of said sound absorbing material closing said openings is a nonreticulated fine pore polyester urethane foam.

5. The apparatus of claim 4 wherein the remainder of said sound absorbing material is a nonreticulated fine pore polyester urethane foam.

6. Apparatus as defined in claim 3 wherein said means for mounting said sound absorbing material to the interior of said housing comprises an open area sheet-like material which is shaped to substantially conform to the contours of the interior of said housing which is lined with said sound absorbing material, said open area sheet-like material being removably attached to said housing with said sound absorbing material placed therebetween and retained by said open area sheet-like material.

7. The apparatus of claim 3 wherein said housing has hinge means and is cut so as to open and close, said housing being cut so as to expose said openings when open.

8. The apparatus of claim 3 wherein said rigid housing has a boxlike shape with said openings being disposed in opposing faces thereof.

9. Apparatus as defined in claim 8 wherein one of the faces of said housing is removably attached thereto, said removably attached face being one of the faces normal to and on either side of said faces having said openings, said openings extending in their respective faces to said removably attached face.

10. Apparatus as defined in claim 9 wherein the face opposing said removably attached face of said housing has hinge means thereacross with the ends thereof corresponding to said faces having said openings, each of said faces having said openings also having a slit therethrough which runs from the end of said hinge means to said opening, so that said housing can be opened and closed.

11. Apparatus as defined in claim 10 wherein said means for mounting said sound absorbing material to the interior of said housing comprises an open area sheet-like material which is shaped to substantially conform to the contours of the interior of said housing which is lined with said sound absorbing material, said open area sheet-like material being removably attached to said housing with said sound absorbing material placed therebetween and retained by said open area sheet-like material.

* * * * *